US006540620B1

(12) United States Patent
Consiglio

(10) Patent No.: US 6,540,620 B1
(45) Date of Patent: Apr. 1, 2003

(54) GOLF PUTTER TRAINING DEVICE INCORPORATING PROCESSOR AND COUNTER MECHANISM

(76) Inventor: Joseph Consiglio, 105 Saw Timber Dr., Hilton Head Island, SC (US) 22926

( * ) Notice: Subject to any disclaimer, the term of this patent is extended or adjusted under 35 U.S.C. 154(b) by 0 days.

(21) Appl. No.: 09/661,870

(22) Filed: Sep. 14, 2000

(51) Int. Cl.[7] ..... A63B 67/02
(52) U.S. Cl. ..... 473/150; 473/257
(58) Field of Search ..... 473/150, 151, 473/152, 153, 155, 157, 158, 173, 190, 192, 195, 196, 198, 199, 405; 434/252

(56) References Cited

U.S. PATENT DOCUMENTS

| | | | | | |
|---|---|---|---|---|---|
| 4,148,490 | A | * | 4/1979 | Goransson | 473/158 |
| 4,872,687 | A | * | 10/1989 | Dooley | 473/152 |
| 5,209,484 | A | | 5/1993 | Randall | 473/265 |
| 5,290,037 | A | * | 3/1994 | Witler et al. | 473/100 |
| 5,429,368 | A | | 7/1995 | Adams | 473/162 |
| 5,527,041 | A | | 6/1996 | Terry, III et al. | 473/150 |
| 5,647,805 | A | * | 7/1997 | Tarbox, Jr. | 473/132 |
| 5,672,114 | A | | 9/1997 | Tu | 473/164 |
| 5,788,583 | A | | 8/1998 | Agulnek et al. | 473/225 |
| 5,797,804 | A | | 8/1998 | Chen | 473/260 |
| 5,882,267 | A | | 3/1999 | Roe | 473/172 |

* cited by examiner

*Primary Examiner*—Valencia Martin-Wallace
*Assistant Examiner*—Aaron L. Enatsky
(74) *Attorney, Agent, or Firm*—Gifford, Krass, Groh, Sprinkle, Anderson & Citkowski, P.C.

(57) ABSTRACT

A putter training device for judging a speed of impact of a golf club head upon a golf ball and including an elongated structure with a first guide wall and a second spaced apart and substantially parallel extending guide wall. A golf ball placement position is located at a first interconnecting end of the spaced apart guide walls. An adjustable and cross wise extending passageway with pivoting flaps is located proximate a second interconnecting end and determines a selected width for allowing passage therethrough of a golf ball which is struck at said placement portion and travels along the elongated structure between the first and second guide walls. A sensor circuit includes first and second pairs of spaced apart sensors mounted in opposing fashion and at spaced apart locations to the first and second guide walls. A counter assembly including a logic circuit interfaces with the sensor circuit to signal start and stop positions of the sensor circuit dependent upon first and second travel positions of the golf ball. A digital to analog converter is communicable with the logic circuit and converting an incremented output from the sensors for subsequent presentation on a display circuit. A power supply communicates with the sensor circuit, counter assembly, digital to analog converter and display circuit for supplying an electrical power input.

10 Claims, 7 Drawing Sheets

GOLF PUTTER TRAINING DEVICE INCORPORATING PROCESSOR AND COUNTER MECHANISM

BACKGROUND OF THE INVENTION

1. Field of the Invention

The present invention relates generally to golf assist and training devices and, more particularly, to a putter training device which incorporates an elongated structure with first and second spaced apart guide walls and a selected end wall incorporating a cross wise adjustable passageway; the invention is further specifically directed to the provision of a counter assembly located proximate the end wall for determining, by pairs of spaced apart sensors, a numerical increment and corresponding to a time of travel of a golf ball. The duplicating of a desired and digital to analog converted readout is desired during consecutive putting strokes to match a projected distance of travel of the golf ball.

2. Description of the Prior Art

The present invention is well documented with many types and varieties of golf putting and training devices, the professed goal of each is to improve, through repetition, the ability of a user to strike a golf ball in a desired direction and over a specified distance corresponding. A first example of such a golf putting trainer is disclosed in U.S. Pat. No. 5,882,267, issued to Roe, and which discloses first and second elongated members positioned in a generally parallel and spaced apart manner. A connecting member is positioned between the first and second elongated members near a first selected end of the members and is connected, such as by an axle, therebetween. A target is slidably mounted to the connecting member and is in a slidable relationship with the connecting member, wherein the target is positioned between the first and second elongate members.

U.S. Pat. No. 5,788,583, issued to Agulnek et al., discloses a system and method for predicting a distance which will be imparted to a golf ball by a putting swing. The apparatus in Agulnek includes a first optical sensor located in a first position for sensing when a putter head of a golf putter travels over the first position. A second optical sensor is located in a second position for sensing when the putter club head travels over the second position during the putting swing. A timer, coupled to the first and second sensors, generates a time difference value representing the travel of the putter head between the first and second sensors. A microprocessor is provided and determines a predicted distance to be imparted to the golf ball in accordance with the time difference value and the predetermined distance. A converted readout of the distance value is also disclosed by the system of Agulnek.

U.S. Pat. No. 5,429,368, issued to Adams, teaches a still further variation of a portable practice putting device and which includes a plurality of elongated panels connected together by hinges to form an elongated structure. A sheet of grass-like material is bonded to the top surface of the panels and includes a putting hole portion having a golf ball receptacle. An elongated strip portion extends to the front end of the elongated structure and a putting stroke zone is formed adjacent the front end of the elongated structure. A putting stroke zone is formed adjacent the front end of the elongated structure in has a plurality of lines of golf tee apertures extending parallel to the putting stroke zone. The golf tees are placed into the particular lines of apertures that would have a spaced width apart closes to that of the diameter of the putter head. When not in use, the practice putting device is capable of being folded into a compact closed state.

SUMMARY OF THE PRESENT INVENTION

The present invention is a repetitive putter training device useful for judging the speed of impact of a golf putter head upon a golf ball, by virtue of tracking a speed of travel of the golf ball between first and second selected linear positions remote from the striking location of the ball. The device is also useful for assisting in training the user to strike succeeding balls with a repetitive degree of force and direction and to thereby achieve a desired overall distance of travel.

The device includes an elongated structure having a first guide wall and a second spaced apart and substantially parallel extending guide wall. The guide walls are secured at first and second interconnecting ends, the first end being defined by a golf ball placement position notched into an edge of a cross wise extending planar shaped member, or plate.

A golf ball dispensing magazine is located proximate the first interconnecting end of the guide walls and dispenses, in succeeding fashion, a plurality of golf balls. The dispensing magazine further includes an elongated and sleeve shaped member mounted to one of the guide walls. The sleeve shaped member includes a first upwardly angled loading end and a second downwardly angled dispensing end. An aperture is formed in the guide wall to permit each succeeding one of the plurality of golf balls to be successively dispensed to the placement area and for being positioned and struck by the golf putter.

A cross wise extending and adjustable mechanism is located proximate the second interconnecting end and determines a selected passageway width for allowing passage therethrough of a golf ball traveling along the elongated structure and between the first and second guide walls. The mechanism includes a housing secured in extending fashion between the first and second guide walls, the housing including an open interior. First and second spaced apart and adjustable racks are slidably secured against associated first and second cross wise extending and facing surfaces of the housing interior, each of the racks including an opposing and toothed edge which is meshingly engaged by a rotary gear, the rotary gear in turn connected to a knob extending upwardly from the housing. First and second flaps extend downwardly from the associated first and second racks, the flaps each further include opposing and arcuate shaped configurations defining in combination a ball passageway. The first and second flaps are also pivotally secured to their associated and cross wise adjustable racks and so as to determine when a selected one of the flaps is contacted by the traveling golf ball.

A counter assembly includes a sensor circuit having first and second pairs of spaced apart sensors mounted in opposing fashion and at spaced apart locations along the first and second guide walls. The pairs of sensors are preferably mounted at such spaced locations proximate the second interconnecting end. A logic circuit interfaces with the sensor circuit to signal start and stop positions of the sensor circuit dependent upon first and second travel positions of the golf ball. A digital to analog converter is communicable with the logic circuit and converts an incremented output from the sensors for subsequent presentation on a display circuit. A power supply is communicable with the sensor circuit, counter assembly, digital to analog converter and display circuit for supplying an electrical power input.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
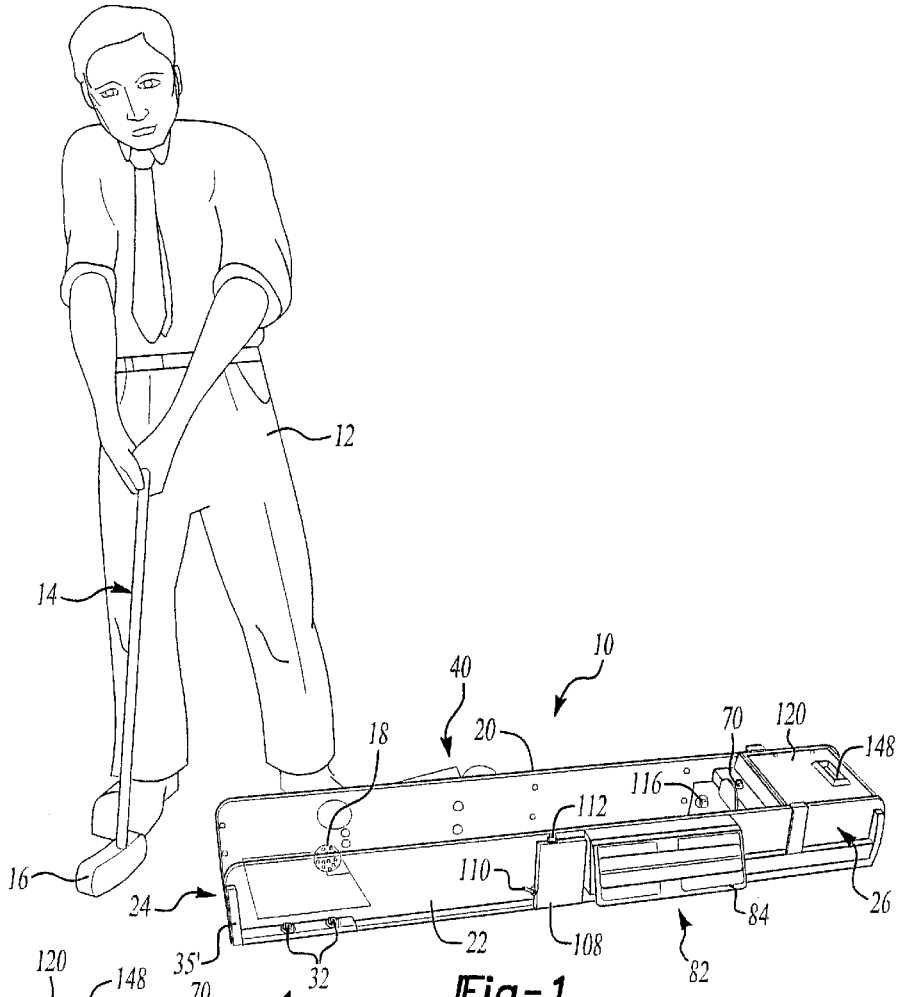
FIG. 1 is an operational view, in perspective, of the putter training device according to the present invention.

Referring now to FIG. 1, a putter training device is illustrated at 10 and which employed by a user 12 holding a golf putter 14 with a putter head 16. As previously stated, the device 10 is useful for judging the speed of impact of a golf putter head 12 of a putter 14 upon a golf ball 18. The device 10 is also useful for assisting in training the user to strike succeeding balls with a repetitive degree of force and direction and to thereby achieve the ability to strike a number of golf balls, all traveling a desired overall distance.

Figure 2:
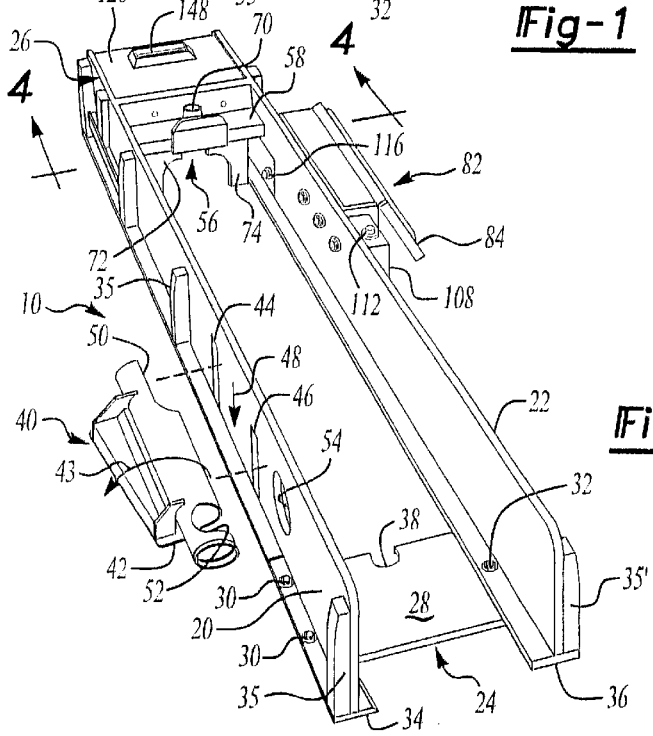
FIG. 2 is a rotated view in perspective illustrating the putter training device from another angle and illustrating both the attachable aspect of the golf ball dispensing magazine and the placement and arrangement of the power supply unit and counter, display unit.

The putter training device 10 includes an elongated structure with a first generally upwardly extending guide wall 20 and a second spaced apart, substantially parallel, and generally upwardly extending guide wall 22. The first and second guide walls 20 and 22 are secured at first 24 and second 26 interconnecting ends such that unobstructed pendulum or straight travel of the putter 14 and putter 12 is permitted. The first interconnecting end 24 includes a generally flattened, or plate shaped, member 28 and which is secured to the guide walls 20 and 22, respectively, by first 30 and second 32 pluralities of bolts. As best illustrated in the rotated perspective view of FIG. 2, the bottom surface of the first guide wall 20 is defined by a first perpendicular ledge 34 and the corresponding bottom surface of the second guide wall 22 is defined by a second perpendicular ledge 36 and such that the ledges provide supporting surfaces for being engaged by the pluralities of bolts 30 and 32. Vertical supports 35 and 35' are provided, respectively, on both sides of the device and to secure the guide walls 20 and 22 in upwardly extending vertical fashion to the ledges 34 and 36. The flattened, plate shaped member 28 includes a notch 38 for assisting in locating the ball 18. The guide walls 20 and 22 in the preferred construction are made of a durable material and it is also contemplated that the elongated unit, including the guide walls 22 and 24 and the first and second interconnecting ends (including the plate shaped member 28) will be manufactured of a durable and high strength polymer material, such as in an injection molding process, or other suitable forming process.

Referring again to FIG. 2, a golf ball dispensing magazine 40 is located proximate the first interconnecting end 24, and secured to an outwardly facing surface of the first elongate extending guide wall 20. The dispensing magazine 40 is constructed as an elongated and sleeve shaped member having secured thereto, such as by molded integral mounting slides 42. The dispensing magazine 40 is further illustrated in 90° degree offset fashion for purposes of clarity of representation, it further being understood that the magazine 40 is rotated in the direction of arrow 43 prior to being installed on the guide wall 20. Extending from the outwardly facing side of the guide wall 20, and in spaced apart fashion, are first 44 and second 46 guide portions. The spacing of the guide portions 44 and 46 is such that the dispensing magazine 40 is positioned with the associating edge of the mounting slides 42 arrayed in aligning fashion with the guide portions 44 and 46. The integral mounting slide 42 is then slidably engaged in a downward fashion, along the direction of arrow 48, and so that the magazine 40 is secured against the outwardly facing surface of the guide wall 20.

The sleeve shaped dispensing member 40 is configured, upon being installed, so that it includes a first upwardly angled loading end 50 and a second downwardly angled dispensing end 52. The loading end 50 of the sleeve shaped member 40 is open so that consecutive golf balls, up to any desired plurality, may be inserted and will roll downwardly until they either are arrayed at the downwardly angled and apertured open end 52 or until the plurality of golf balls are stacked so that they completely fill the magazine 40. An aperture 54, typically elongated in shape, is formed in the first guide wall 20 at a selected location proximate the downwardly angled and apertured open end 52 formed in the sleeve dispensing member 40 and such that each succeeding one of a plurality of golf balls held within the magazine 40 may be successively dispensed, such as through manipulation of the golf putter head 16, to the placement area defined by the notch 38 in the interconnecting plate 28. Having described one construction of a golf ball dispensing magazine, it is understood that other types of loading and dispensing magazines may be provided for iteratively feeding golf balls to the desired placement position and with a minimum of effort. It is also contemplated that the putter device 10 of the invention, if need be, can operate without the provision of a manual (or possibly electric) ball feeding device, however it is advantageous to provide such a magazine device for holding a plurality of individual golf balls.

Figure 4:
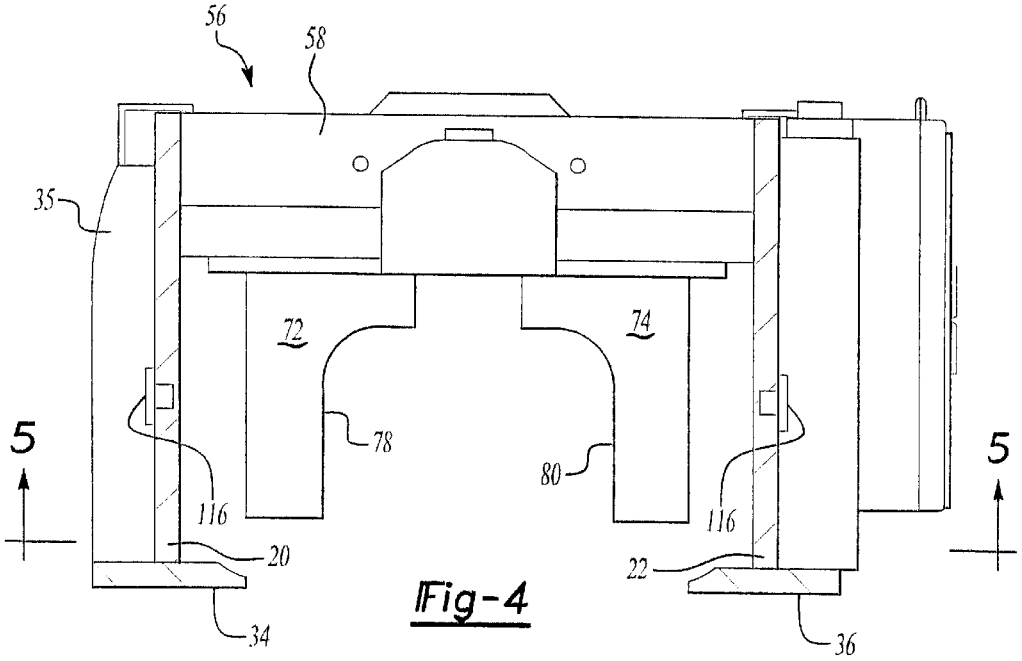
FIG. 4 is a cutaway view taken along line 4—4 of FIG. 2 and illustrating the adjusting mechanism for establishing a selected passageway width for permitting golf ball travel, as well as illustrating a first selected pair of sensors for activating the counter assembly.
Figure 5:
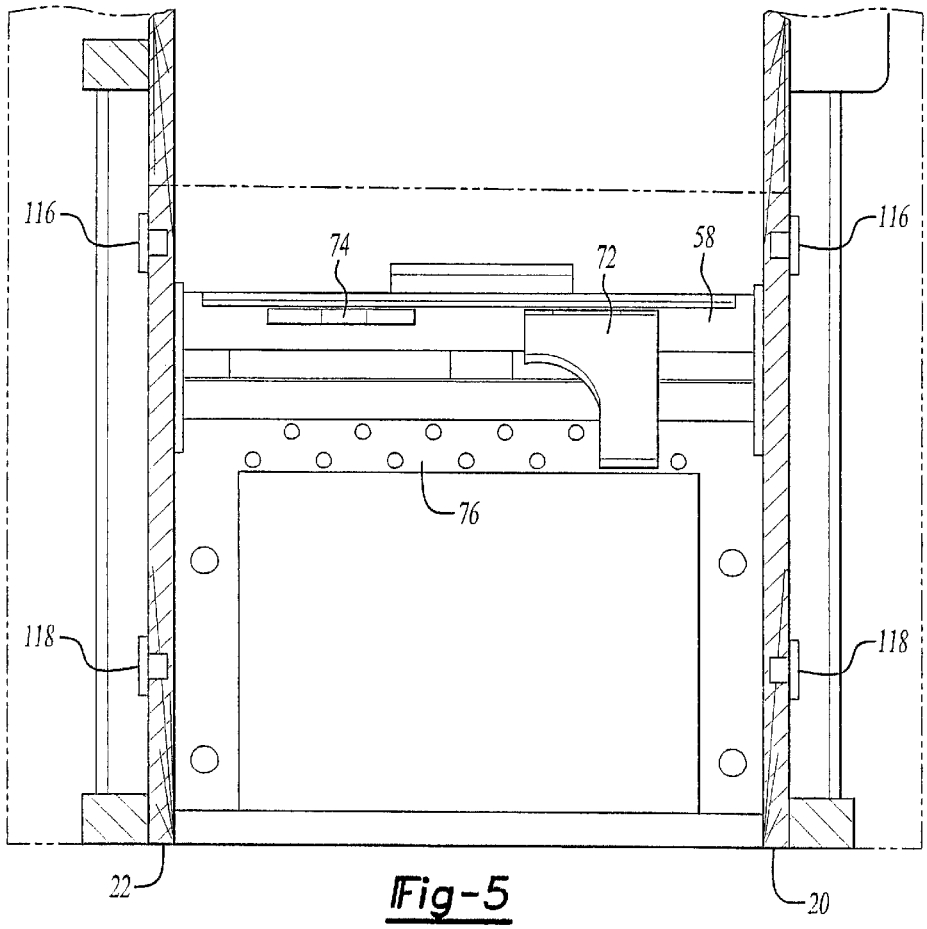
FIG. 5 is a cutaway taken along line 5—5 of FIG. 4 and illustrating an underside view of the adjusting mechanism area and showing the pivotal nature of the first and second flaps.
Figure 6:
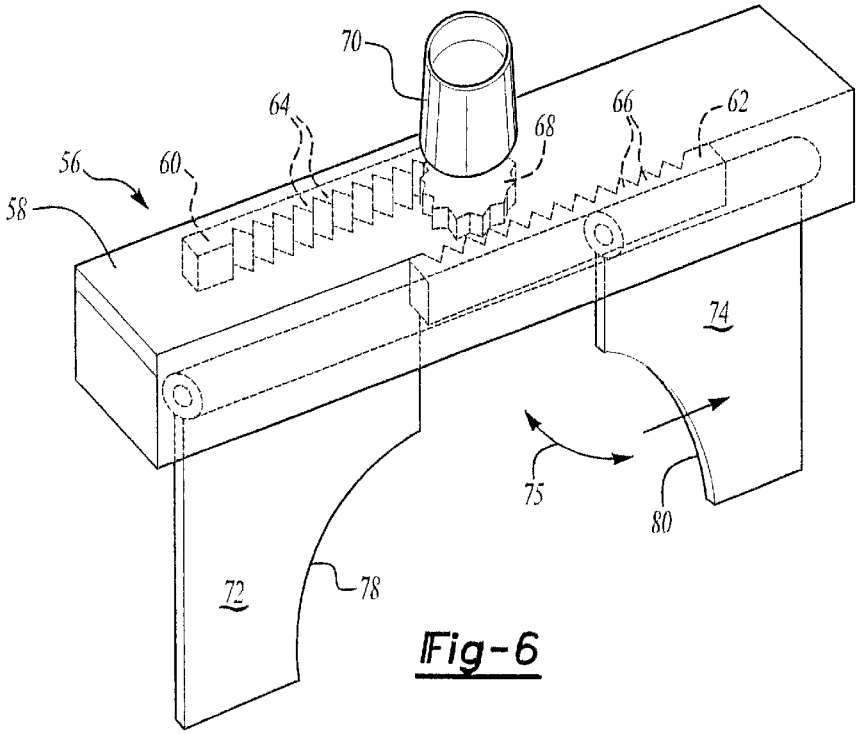
FIG. 6 is a sectional view in perspective of the cross wise extending and adjustable mechanism and illustrating the housing with slidably adjustable racks, meshingly engaging rotary gear and pivotally attachable flaps.

Referring again to FIGS. 1 and 2, as well as to FIGS. 4, 5 and 6 in succession, an adjustable mechanism 56 is provided proximate the second interconnecting end 26 and is arrayed in crosswise extending fashion between the first and second guide walls 20 and 22. As is best illustrated in the perspective view of FIG. 6, the adjustable mechanism 56 includes a housing 58 secured in extending fashion between the first and second 22 guide walls. As is again best shown in FIG. 6, the housing 58 includes a cross wise extending open interior within which are located a first adjustable rack 60 and a second spaced apart adjustable rack 62. The first and second racks 60 and 62 are illustrated in phantom slidably secured against associated first and second cross wise extending and facing surfaces of said housing 58 interior. Each of the racks includes an opposing and toothed edge, such as a multiple toothed edge 64 for first rack 60 and multiple toothed edge 66 for second rack 62. The toothed edges 64 and 66 of the racks 60 and 62 are meshingly engaged by an internally toothed and rotary gear 68, which is in turn connected to a knob 70 extending upwardly from a top surface of the housing 58.

A first flap 72 is secured in pivotal fashion to a downwardly facing surface of the first laterally adjustable rack 60 and a second flap 74 is likewise secured in likewise pivotal fashion to a corresponding and downwardly facing surface of the second adjustable rack 62. Referring to the underside view of FIG. 5, and as is further defined by the underside upper surface 76 in proximity to the adjustable mechanism 56, is it also illustrated how, upon a golf ball striking a selected one of the flaps (such as second flap 74), the flap will tend to pivot by virtue of the pendulum effect (see also directional arrow 75 of FIG. 6). By virtue of pendulum movement, it is illustrated when a golf ball has struck one of the flaps 72 or 74. Each of the flaps 72 and 74 further includes and opposing and arcuate shaped configuration, such as at 78 and 80, respectively, and which defines in combination a ball passageway.

Figure 3:
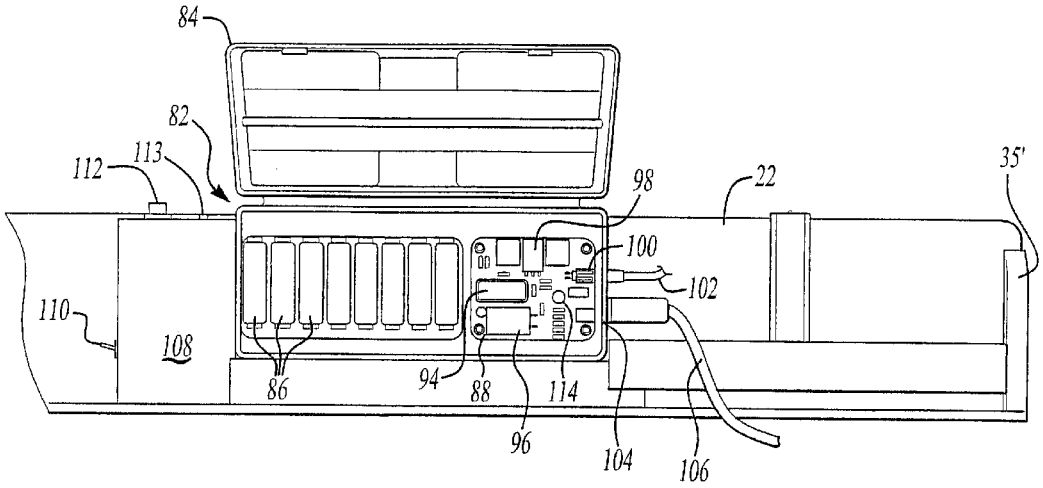
FIG. 3 is a partial side view of the putter training device and revealing the circuit board components of the power supply.

Referring now to FIG. 3, a power supply unit 82 is illustrated and which, in the preferred embodiment, is secured against an outwardly facing surface of the second elongate extending guide wall 22. The purpose of the power supply unit 82 is to provide a constant electrical input to sensor, logic, digital to analog conversion and display circuit assemblies all incorporated into the present device and which will be subsequently described in greater detail with further reference to FIGS. 7, 10 and 11.

Referring again to FIG. 3, the power supply unit 82 is contained within a reclosable housing including a lid 84 and includes a power supply input. The power supply input according to a first preferred variant consists of a plurality of individual battery cells 86, the battery cells in the preferred variant including either non-rechargeable throwaway or nickel cadmium (Ni—Cd) re-chargeable cells supplying 9.6 Volts DC, (Type AA, 1.2 Vdc each). The battery cells are further mounted upon a battery PCB 88 (see also FIG. 9) and a battery charger 90 interconnects the battery PCB 88 with a main PCB 92 for issuing a power signal to the operating circuitry of the device 10 (FIG. 1).

Components of the main PCB 92 are also illustrated in circuit board arrangement in FIG. 3 and include microprocessor 94, capacitor 96, and heat sink 98 elements. An output port 100 of the circuit board carries the power signal along communication lines 102 extending therefrom and to the operating circuitry of the device. An AC output port 104 is also provided and is engaged by a plug 106 for supplying the device with standard electrical input and in lieu of the battery supply. It is also contemplated that the preferred embodiment will incorporate both the portable battery supply and a separately attachable AC input port, depending upon the power source choice and availability in which the device is used.

Figure 8:
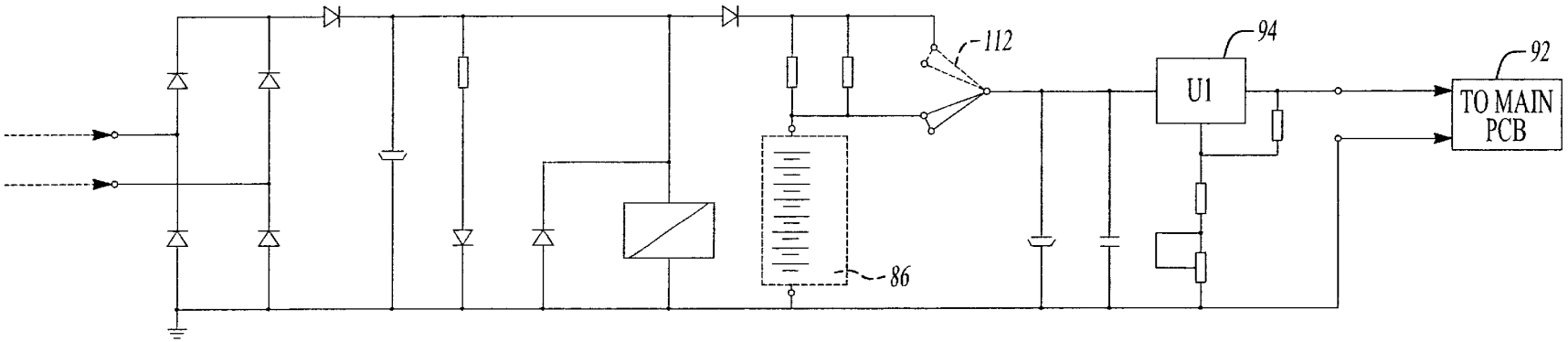
FIG. 8 is schematic of the battery charger and power supply PCB board according to the present invention.
Figure 9:
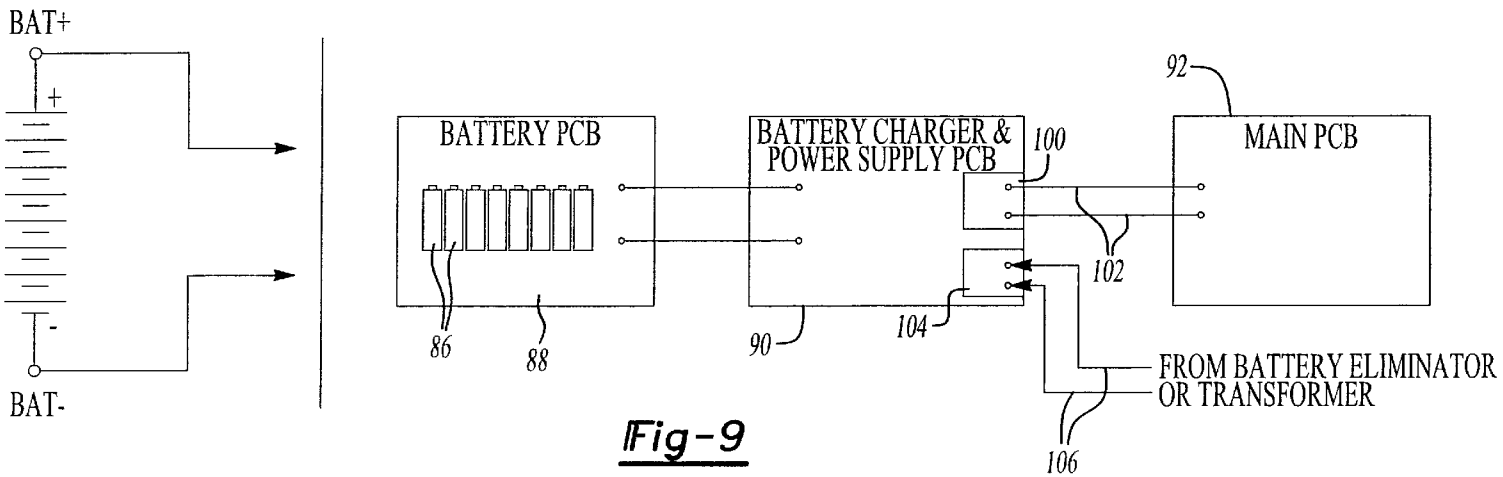
FIG. 9 is a diagrammatic view of the interconnection between the battery PCB, battery charger and power supply PCB and main PCB, forming portions of the schematic also shown in FIG. 8.

Referring again to FIG. 3, and also to FIGS. 8 and 9, an additional start/reset unit 108 is illustrated, also secured to the second extending guide wall 22 in proximity to the power supply unit 82, and including an on/off switch 110, a reset button 112 and a power on display LED indicator 113 for resetting the power supply in response to the operation of the various circuit assemblies to be subsequently described. Referring once again to the circuit board illustration in FIG. 3, an LED indicator 114 is arranged on the circuit board for indicating when power is being supplied to the operating circuitry.

A detailed description will now be made of the various circuits and components, supplied with the power input, and which make up the counter assembly of the present invention and assist in training a user in skillfully repeating a repetitive putting stroke by incrementing and presenting a digitally to analog converted number associated with a traveling speed of a golf ball between first and second travel positions along the device 10. Referring to the general diagrammatic view of FIG. 7, a counter assembly is provided and includes, as a first component, a first pair 116 of sensors and a second pair 118 of sensors. Each of the pairs 116 and 118 of sensors are mounted in opposing fashion and at spaced apart locations to the first 20 and second 22 guide walls.

Figure 7:
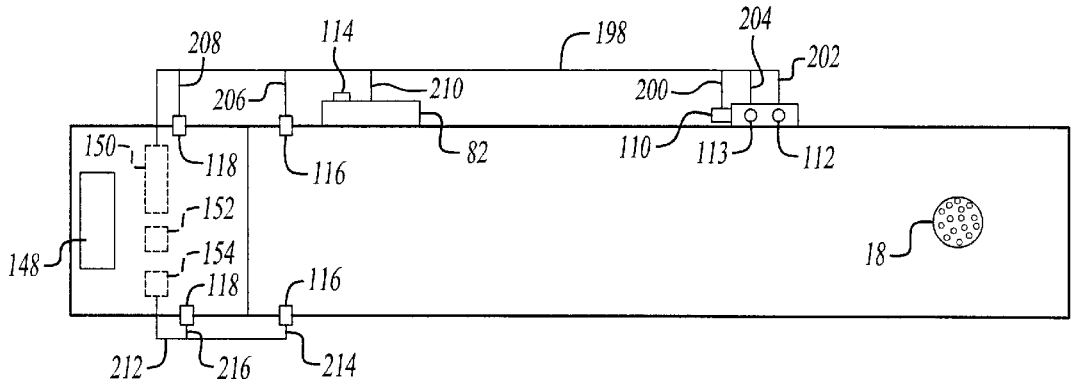
FIG. 7 is a block diagram illustrating the connections between the power supply, the counter assembly and the pairs of LED sensors according to the present invention.

According to the preferred variant, the pairs of sensors 116 and 118 are infrared light emitting diodes which each operating as a photo transmitter and photo transistor. Referring further to the several views of FIGS. 1, 2, 4 and 5, one or both of the first pair of LED sensors 116 is illustrated, the second pair 118 being substantially hidden from view. It is however understood that the pairs of sensors 116 and 118 are preferably located at any desired spaced apart distance, one example being 150 mm from each other and so that the second pair 118 of sensors diagrammatically illustrated in FIG. 7 is also evident located underneath display unit 120 mounted at the second interconnecting end of the elongate extending guide walls 20 and 22. The diagrammatic view of FIG. 7 also illustrates portions of the power supply input, these including the power on/off switch 110, the reset button 112 and the power on LED indicator 113.

Figure 10:
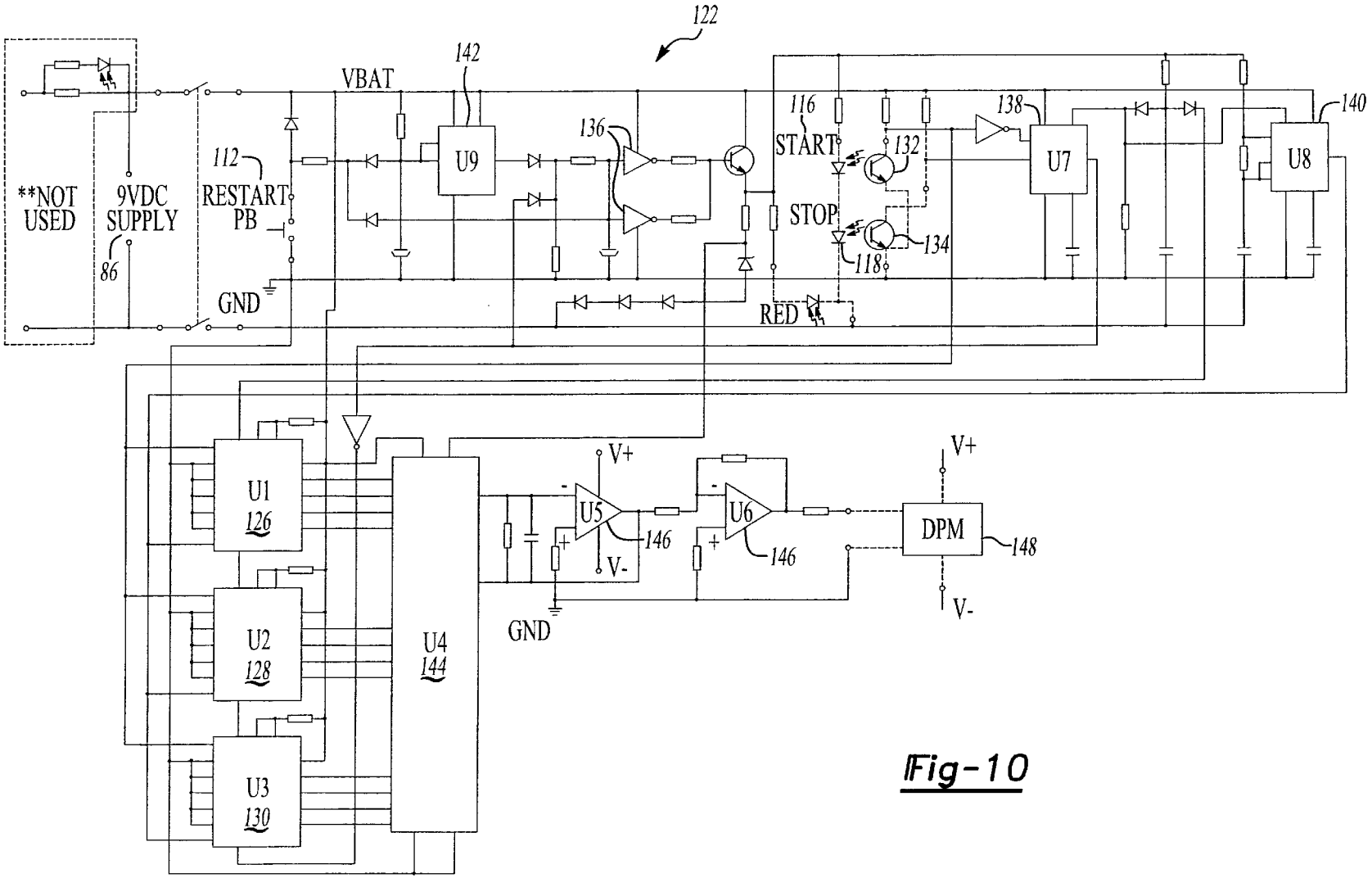
FIG. 10 is a display circuit schematic illustrating the various components of the logic circuit of the counter assembly.
Figure 11:
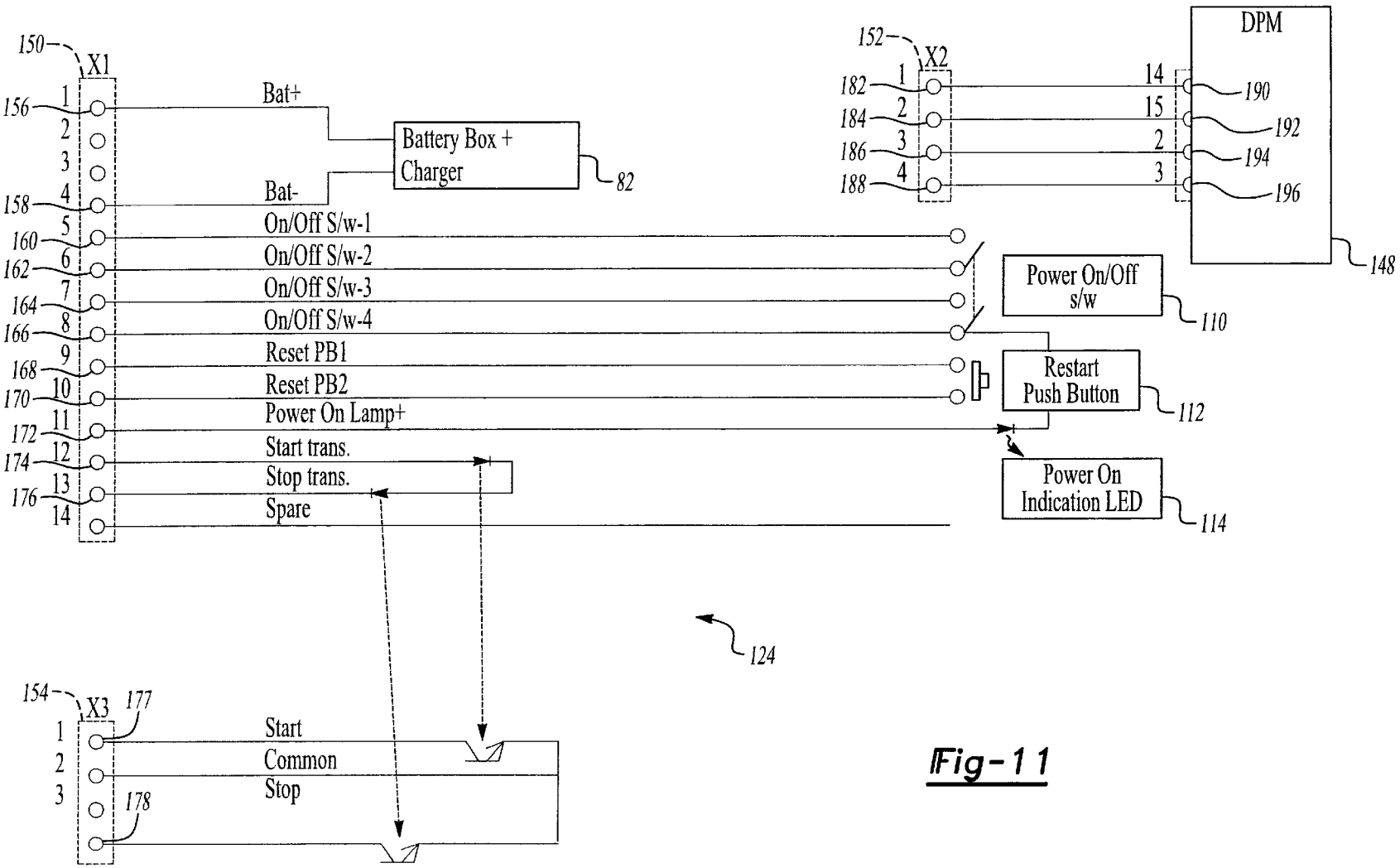
FIG. 11 is a JBG display assembly illustrating, diagrammatic view, the first, second and third connector cables forming a part of the counter assembly and interfacing with the first and second pairs of sensors to activate and deactivate the counter assembly.

Referring also to FIGS. 10 and 11, logic and display diagrams are illustrated, at 122 and 124, respectively, and which provide a somewhat more detailed explanation of the manner in which the sensor pairs 116 and 118 interact with the logic, conversion and display circuitry. First 126, second 128 and third 130 counters are utilized in combination with the pairs of LED sensors 116 and 118 to signal both start and stop positions of the sensor pairs dependent upon the first and second selected travel positions of the golf ball. The start position is triggered when the moving golf ball 18 interrupts a light beam extending between the first opposing pair of sensors 116 and the stop position when the ball 18 subsequently interrupts the light beam extending between the second pair 118 of sensors.

Referring again to FIG. 10, the pairs of LED sensors are again illustrated at 116 and 118 in communication with photo transistor elements 132 and 134. Upon tripping the start position defined by the beam between the first pair of sensors 116, integrated circuit inverter 136 is converted from a logical level state "0" to a logical level state "1" and which then enables the counter integrated circuits 126, 128 and 130. A selected pin of the third counter 130 starts counting in digital fashion until a stop signal is triggered by the ball 18 breaking the beam established between the second pair of sensors 118, at which time logical level state "0" is converted to "1" and the circuit inverter 136 signals a further selected pin of the third counter 130 to stop counting. First 138, second 140 and third 142 integrated circuit timers are also provided in the logic circuitry and combine to deactivate the power supply to the operating circuitry at selected time intervals, such as 30 seconds between golf stroke iterations. Additional description of this function will be subsequently made with an operational explanation of the device.

A digital to analog converter (DAC) circuit 144 is provided and communicates in series with each of the first 126, second 128 and third 130 counters. The DAC circuit 144, upon being supplied with a digitally incremented count corresponding to the duration of ball 18 travel between the start (sensors 116) and stop (sensors 118) positions, converts the input into an analog output voltage, through the utilization of integrated circuit Op-Amps 146, which corresponds to the digital counter value. The converted analog output voltage is then inverted with a selected gain value and is then fed to a digital panel meter (DPM) 148, preferably a liquid crystal display (LCD) readout which includes four digits requires significantly less power input than other types of readout display. Another feature of the DPM/LCD display 148 is that, when notified by the operating circuitry, it indicates when a battery power source has gone low and requires replacement.

Referring finally again to the diagrammatic scheme of FIG. 7 and the operating system diagram of FIG. 11, a brief description of the operation of the present device will now be given. In brief, first 150, second 152 and third 154 connectors are utilized for assembling and conveying the power input source to the operating circuitry, starting/stopping/resetting the counter assembly, and converting and posting the analog output. The first connector 150 includes a plurality of ports which perform such functions as receipt of a battery input source (at pins 156 and 158), as well as activating and deactivating the power input (pins 160, 162, 164 and 166), resetting the counter assembly (pins 168 and 170), indicating the power on lamp (pin 172), also illustrated at 114 in FIG. 3, starting the counter (pin 174) and stopping the counter (pin 176).

The third connector 154 is in operation with the starter counter pin 174, at pin 177, instructing the IC counters 126, 128 and 130 to begin incrementing. Pin 178 is in connection with the stop counter pin 176 and instructs the counters 126, 128 and 130 to cease incrementing.

The second connector 152 includes pins 182, 184, 186 and 188 in communication, respectively, with pins 190, 192, 194 and 196 of the DPM 148 and so as to instruct the digital to analog conversion and posting of the incremented value on the LCD display. Referring again to FIG. 7, the wiring connection 198 for the first connector 150 corresponds with what is described in reference to the system view of FIG. 11 and includes wiring connection 200 to on/off switch 110, wiring connection 202 to the reset button 112, wiring connection 204 to the LED power display 113, wiring connection 206 to a first selected one of the first pair of sensors 116, wiring connection 208 to a first selected one of the second pair of sensors 118 and wiring connection 210 to the battery supply housing and charger 82. The wiring connection 212 for the third connector 154 includes wiring connection 214 to a second selected one of the first pair of sensors 116 and wiring connection 216 to a second selected one of the second pair of sensors 118. Finally the wiring connections between the second connector 152 and the DPM 148 are hidden in view in FIG. 7, it being understood that they are contained within the display housing 120.

In operation, the user turns the power switch 110 on so that the power on the LED indicator 113 is illuminated. Upon feeding a selected golf ball 18 (perhaps from a plurality of balls stored in dispensing magazine 40) the ball is struck by the putter head 16 of the users golf putter 14, the start and stop signals are triggered in succession as a result of the moving golf ball consecutively interrupting the pairs of sensors 116 and 118, and the digital to analog converted readout is posted on the DPM/LCD display. The readout is, in the preferred variant, maintained constant for a period of five (5) seconds on until a succeeding ball is struck. The timer and power saving circuitry in the system will go into automatic power saving mode after approximately 30 seconds if a succeeding ball is not struck and until the reset button 112 is depressed. The pivotal flaps 72 and 74 of the cross wise adjustable mechanism 56 are adjusted to a desired lateral spacing and so that the user can practice hitting the ball between succeedingly narrowed passageways formed between the flaps.

Having described my invention, it is apparent that it discloses a novel and useful putter-training device for assisting a user in achieving a desired skill level in the repetitious control and adjustment of the force exerted in putter-to-ball contact and for judging the speed of the ball, which determines its travel distance. Based upon the incremental number measurement achieved by the counter assembly, a lower measurement is indicative of a faster traveling ball and a higher number measurement being indicative of a slower traveling ball. Additionally, using the adjustable sliding/pivoting flaps as visual alignment indicators progressively teaches and improves the user's ball-hitting technique on a consistent basis. While the preferred variant illustrates a right handed putting device, it is also understood that the device of the present invention can easily accommodate left handed putting. Further preferred embodiments of the present device will become apparent to those skilled in the art to which it pertains and without deviating from the scope of the appended claims.

I claim:

1. A putter training device for judging a speed of impact of a golf club head upon a golf ball, comprising:

an elongated structure including a first guide wall and a second spaced apart and substantially parallel extending guide wall, said first and second guide walls being interconnected at first and second interconnecting ends;

a golf ball placement position located proximate said first interconnecting end;

a cross wise extending and adjustable mechanism located proximate to said second interconnecting end and determining a selected passageway width for allowing passage therethrough of a golf ball traveling along said elongated structure and between said first and second guide walls, said cross wise extending and adjustable mechanism further comprising:

a housing secured in extending fashion between said first and second guide walls, said housing including an open interior;

first and second spaced apart and adjustable racks slidably secured, against associated first and second cross wise extending and facing surfaces of said housing interior, each of said racks including an opposing and toothed edge which is meshingly engaged by a rotary gear, said rotary gear in turn connected to a knob extending upwardly from said housing;

first and second adjustable flaps extending downwardly from said associated first and second racks, said flaps each further including opposing and arcuate shaped configurations defining in combination a ball passageway;

a sensor circuit including first and second pairs of spaced apart sensors mounted in opposing fashion and at spaced apart locations to said first and second guide walls, a counter assembly including a logic circuit interfacing with said sensor circuit to signal start and stop positions of said sensor circuit dependent upon first and second travel positions of the golf ball, a digital to analog converter being communicable with said logic circuit and converting an incremented output from said sensors for subsequent presentation on a display circuit; and a power supply communicable with said sensor circuit, counter assembly, digital to analog converter and display circuit for supplying an electrical power input.

2. The putter training device according to claim 1, said power supply further comprising at least one battery mounted to a battery PCB and which is communicable with a main PCB for issuing a power signal to said counter assembly.

3. The putter training device according to claim 2, further comprising a battery charger and power supply PCB interconnecting said battery PCB and said main PCB, an external jack communicating with an input port of said battery PCB to provide, alternate to said at least one battery, an AC power input.

4. The putter training device according to claim 3, said power supply further comprising an on/off switch, a power LED indicator, and a counter assembly reset button.

5. The putter training device according to claim 1, said first and second pairs of sensors each further comprising an infrared light emitting diode operating as a photo transmitter and a photo transistor, said start position of said counter assembly occurring upon the golf ball interrupting at said first travel position a light beam extending between said first opposing pair of sensors, said stop position occuring upon said golf ball interrupting at said second travel position a light beam extending between said second pair of opposing sensor.

6. The putter training device according to claim 5, said logic circuit further comprising a microprocessor operatively communicating with first, second and third counter circuits.

7. The putter training device according to claim 1, said digital to analog converter providing an analog output voltage corresponding to a digitally inputted value from said counter assembly.

8. The putter training device according to claim 1, said display circuit including a digit panel meter having four digits of liquid crystal display.

9. The putter training device according to claim 8, said digital panel meter further comprising a low battery display output from said power supply.

10. The putter training device according to claim 1, further comprising said first and second flaps each being pivotally secured to said associated and cross wise adjustable racks and facilitating a visual perception of moving ball alignment.

* * * * *